United States Patent [19]

Bender

[11] Patent Number: 4,560,390

[45] Date of Patent: Dec. 24, 1985

[54] METHOD OF BENEFICIATING COAL

[76] Inventor: Robert Bender, 325 Castlegate Rd., Pittsburgh, Pa. 15221

[21] Appl. No.: 534,618

[22] Filed: Sep. 22, 1983

[51] Int. Cl.[4] ..... C10L 9/02

[52] U.S. Cl. ..... 44/15 R

[58] Field of Search ..... 44/15 R; 201/17

[56] References Cited

U.S. PATENT DOCUMENTS

| | | | |
|---|---|---|---|
| 3,988,120 | 10/1976 | Chia | 44/1 |
| 4,162,898 | 7/1979 | Anthony et al. | 44/1 |
| 4,167,397 | 9/1979 | Grant | 44/1 |
| 4,169,710 | 10/1979 | Jensen | 44/1 |
| 4,226,601 | 10/1980 | Smith | 44/10 |
| 4,233,034 | 11/1980 | Miller et al. | 44/15 R |
| 4,256,464 | 3/1981 | Ray | 44/1 |
| 4,304,573 | 12/1981 | Burgess et al. | 44/51 |
| 4,305,815 | 12/1981 | Hefner, Jr. | 209/166 |
| 4,328,002 | 5/1982 | Bender | 44/15 R |
| 4,332,593 | 6/1982 | Burgess et al. | 44/51 |

FOREIGN PATENT DOCUMENTS

| | | | |
|---|---|---|---|
| 2815180 | 10/1978 | Fed. Rep. of Germany | 44/15 R |

OTHER PUBLICATIONS

"Coal Desulfurization Prior to Combustion", Robert C. Eliot, EPA Studies, pp. 103–106, Noyes Data Corp., Park Ridge, N.J., 1978.

McCutcheon, J. W. *Synthetic Detergents,* MacNair--Dorland Co., N.Y. (1950).

Rosen, M. J. et al., *Systematic Analysis of Surface Active Agents,* 2nd ed., Wiley-Interscience (John Wiley & Sons), NY (1972).

Plaksin, I. N. (Chief Ed.) "New Methods of Increasing the Effectiveness of Concentration of Minerals", Academy of Sciences of the U.S.S.R., A. A. Skochinskii Mining Institute, translated from Russian, Nat. Tech. Inform. Service, U.S. Dept. of Commerce, T T-70 53095 (1973).

Van Le, Huu, "Floatability of Coal and Pyrite", M. S. Thesis submitted to Iowa State Univ., Nat. Tech. Information Service, U.S. Dept. of Commerce, IS-T-779 (Jul. 1977).

Fisher, R. W. et al., "Advanced Development of Fine Coal Desulfurization and Recovery Technology", Ames Laboratory, Iowa State Univ., Nat. Tech. Inform. Service, U.S. Dept. of Commerce, IS-4113 (Feb. 1977).

Hucko, R. E., "Beneficiation of Coal by Selective Flocculation, a Laboratory Study", Bureau of Mines Report of Investigations, RI 8234, Nat. Tech. Inform. Service, U.S. Dept. of the Interior (1977).

DOE/ET, "Exploratory Study of Coal-Conversion Chemistry", *Quarterly Report,* SRI International, Nat. Tech. Inform. Service, U.S. Dept. of Commerce, DOE/ET/14855-12 (Mar. 4, 1981).

S. Taylor, "Chemical Deashing and Desulfurization of Coal-An Integrated Coal Preparation Process", DOE, Advanced Coal Preparation, Engineering Foundation (NY), U.S. Dept. of Energy, DOE/DC/42294-T 1 (DE 82010502) (1981).

*Primary Examiner*—Carl F. Dees

*Attorney, Agent, or Firm*—Webb, Burden, Robinson & Webb

[57] ABSTRACT

A process for reducing the sulfur and ash content of coal is provided. The process involves cleaning the coal of debris and pulverizing it. The pulverized coal is contacted with a reagent selected from the group consisting of aqueous solutions of active nitrogen containing compounds, aqueous solutions of organic compounds containing at least one hydroxyl group, surfactants containing active ammonium groups and combinations thereof. The coal is washed with water and dried.

10 Claims, No Drawings

METHOD OF BENEFICIATING COAL

BACKGROUND OF THE INVENTION

The invention relates to a method for treating coal to remove sulfur and ash.

Bituminous coal, generally found in the Eastern portion of the United States, contains a large amount of volatile matter, particularly sulfur and ash. Such coal can include as much as 6–8% total sulfur by weight. Inorganic sulfur, generally pyrites or iron sulfide, accounts for between 25% and 75% of the total sulfur content of bituminous coal.

Because of the high sulfur and ash content in bituminous coal, it is not practical to burn such coal on a commercial scale. Users cannot easily and economically comply with the clean air standards of the Environmental Protection Agency for $SO_2$ emissions. Coal burning stationary plants are allowed 1.2 lbs. of $SO_2$ emission per million BTU's of hot input according to recent EPA standards. Thus, the coal burned in such plants must contain no more than 1.5% total sulfur by weight. Further, bituminous coal must compete with anthracite coal, generally found in the Western portion of the United States, which contains 1% or less total sulfur by weight, well within the EPA standards.

Numerous methods have been proposed for removing all or a substantial amount of the sulfur and ash found in bituminous coal. Many of these methods require external applications of heat and/or pressure, some processes invoke so much heat that char forms. Other methods use sophisticated chemical reagents and equipment. These methods are expensive and, thus, are not economically feasible. Further, the processes create environmental problems in disposing of the by-products. Exemplary of these methods are the processes taught in U.S. Pat. Nos. 3,988,120; 4,162, 898; 4,167,397; 4,169,710; 4,226,601; 4,226,602; 4,256,464; 4,304,573; 4,305,815; and 4,332,593. DOE/ET Exploratory Study of Coal-Conversion Chemistry, Quarterly Report, SRI International (1981); DOE, Advanced Coal Preparation, Engineering Foundation (New York) 1981; Plaksin, New Methods of Increasing the Effectiveness of Concentration of Minerals. Academy of sciences of the U.S.S.R., A.A. Skochinskii Mining Institute (1973); Van Le, Floatability of Coal and Pyrite, M.S. Thesis Iowa State University (1977); Fisher et al., Advanced Development of Fine Coal Desulfurization and Recovery, Ames Laboratory, Iowa Sate University (1977); Hucko, Beneficiation of Coal by Selective Flocculation, a Laboratory Study, Bureau of Mines, Report of Investigations (1977).

U.S. Pat. No. 4,328,002 teaches a coal treatment process for desulfurization in which the coal is exposed to an oxidizing reagent/detergent solution and then exposed to a passivating/sequestering reagent and neutralized. The process has the advantage of creating a useful agricultural by-product. Furhter, the process does not require the application of external heat or pressure and the reactions are easily controlled and rapid. However, some of the possible oxidizing reagents are expensive, between two and four cycles of the process are necessary before the sulfur content of the coal is reduced below 1.5%, the process requires several different reagents, the pH of the solutions involved in the process oscillate between 2 and 9, the total reaction time is long, exothermic heating of the coal occurs and noxious odors are created.

Although several prior art methods of coal desulfurization have met with some acceptance, there is a need for a rapid, inexpensive method of desulfurization without the attendant disadvantages extant in the prior art.

SUMMARY OF THE INVENTION

A process treating coal to remove sulfur and ash includes cleaning and pulverizing the coal, treating the coal with an aqueous solution of a compound containing an active nitrogen, an aqueous solution of an organic compound containing at least one hydroxyl group, a surfactant containing active ammonium groups or combinations thereof, and washing and drying the coal. Preferably, the coal is contacted by the aqueous solution for less than one minute. Preferably, the concentration of the reagent or reagents in the solution is between 0.001 and 20% by weight. The process preferably results in an agricultural by-product.

To improve aqueous reagent penetration into harder coal bedding planes and pores and to facilitate ash and sulfur removal, the coal can be pretreated or soaked with any of the reagent solutions (in the preferred concentration range) prior to laboratory or commercial processing. The preferred interval of time for such soaking is between 5 minutes and 48 hours.

DESCRIPTION OF THE PREFERRED EMBODIMENT

In the process of the present invention the coal is cleaned by one of many known methods to remove non-coal debris and pulverized, preferably to a size of less than 4 inches. The coal is then treated with the reagent solution, preferably for a period of less than one minute, washed with water and dried. Preferably, the concentration of the reagent or reagents in the solution is between 0.001 and 20% by weight.

The coal may be treated with the reagent using any one of a number of known processes. One preferred method for processing the coal on a commercial scale is to treat the coal in a dense media classifier using the Tromp method which involves the use of a high density aqueous suspension of magnetite as the dense media. Other methods which may be used include a dense media classifier in which sand or barite is substituted for the magnetite. In the absence of a dense media, processes may be used in which a hydrocyclone jig, screens or centrifugal separation is used to isolate the processed coal.

Suitable reagent solutions include aqueous solutions of compounds containing an active nitrogen, aqueous solutions of organic compounds containing at least one hydroxyl group, surfactants containing active ammonium groups and combinations thereof.

Suitable compounds containing an active nitrogen include both inorganic and organic ammonium salts, amides and amines.

Inorganic ammonium salts suitable for use in the invention include ammonium bicarbonate, ammonium bifluoride, ammonium bisulfide, ammonium bisulfite, ammonium borate, ammonium tetraborate, ammonium bromide, ammonium carbonate, ammonium chloride, ammonium chromate, ammonium dichromate, ammonium ferrous sulfate, ammonium fluoride, ammonium hexafluorosilicate, ammonium iodide, ammonium nitrate, ammonium nitrate sulfate, ammonium nitrite, ammonium perchlorate, dibasic ammonium phosphate, monobasic ammonium phosphate, ammonium silicate, ammonium phosphite, ammonium sulfate, ammonium sulfide, ammonium sulfite, ammonium thiocyanate and ammonium thiosulfate. Preferably, the inorganic salts are ammonium bicarbonate, ammonium borate, ammonium tetraborate, ammonium carbonate, ammonium nitrate sulfate, ammonium nitrite, dibasic ammonium phosphate, monobasic ammonium phosphate, ammonium phosphite, ammonium sulfate and ammonium sulfite.

Organic ammonium salts suitable for use in the invention include ammonium acetate, ammonium benzoate, ammonium binoxalate, ammonium bitartrate, ammonium carbamate, dibasic ammonium citrate, ammonium formate, ammonium lactate, ammonium oleate, ammonium oxalate, ammonium palonitrate, ammonium picrate, ammonium stearate and ammonium tartrate.

Suitable organic compounds containing at least one hydroxyl group include monohydric alcohols, diols, polyols and carboxylic acids. Suitable monohydric alcohols include methanol and ethanol.

Suitable diols include glycol, such as ethylene glycol and dihydricphenols including catechol, resorcinol and giunol.

Suitable polyols include gylcerol and pyrogallol.

Surfactants suitable for use in the present invention include ammonium anionic surfactants, quaternary ammonium cationic surfactants and non-ionic surfactants as described by Rosen and Goldsmith, *Systematic Analysis of Surface-Active Agents,* 1972, p. 12–16 and McCutcheon, *Synthetic Detergents,* 1950, pp. 378–422. The ammonium anionic surfactants include Class IV A1 containing sulfur, but not nitrogen or phosphorus, in the anion and containing nitrogen in the cation, Class IV A2 containing nitrogen and sulfur, but not phosphorus, in the anion and containing nitrogen in the cation and Class V C1 containing phosphorus, but not nitrogen or sulfur in the anion and nitrogen in the cation. The quarternary ammonium cationic surfactants include Class IV A3 and ampholytes containing nitrogen and sulfur, but not phosphorus, in the surface active ion. Non-ionic surfactants include Class V A containing phosphorus.

The processing reagent solution(s), at the same concentration or more dilute concentration, can be applied to the more difficult (harder grindability) coals prior to processing for a soak period of 5 minutes to 48 hours.

In the prior art, values for reductions in sulfur and ash include final density separations, i.e. the values or analyses are for coal isolated from the reject materials. No physical density separations such as float/sink, magnetic separation, froth flotation, centrifugation or hydrocyclone were used to isolate the coal in Examples 1 through 10. However, a limited density separation is inherent in the apparatus used in Examples 11 through 19.

EXAMPLES 1–10

One hundred grams of a Pennsylvania Bakerstown seam coal, $\frac{3}{8}\times 0$ grind, of 3.14% sulfur by weight were reacted with 50 g. of a reagent solution by ball milling for 2 minutes. The coal was screened to 200 mesh and washed with tap water for about 1 minute. All reagent concentrations were 5 to 10% by weight. The surfactants were less than 1% by volume. The processed coal was then washed, dried and analyzed to determine the sulfur content.

| Example | Reagent(s) | % S (dry) by weight processed | % decrease in S content |
|---|---|---|---|
| 1 | hydrogen peroxide/urea | 1.26 | 59.9 |
| 2 | urea | 1.29 | 58.9 |
| 3 | anionic "S" surfactant | 1.28 | 59.2 |
| 4 | ammonium nitrate/ "S" surfactant | 1.31 | 58.3 |
| 5 | nonionic "W" surfactant | 1.19 | 62.1 |
| 6 | nonionic "T" surfactant | 1.21 | 61.5 |
| 7 | ethyl silicate | 1.39 | 55.7 |
| 8 | ammonium nitrate/ ammonium hydroxide | 1.14 | 63.7 |
| 9 | ammonium nitrate/ nitric acid | 1.14 | 63.7 |
| 10 | methanol | 1.09 | 65.3 |

EXAMPLE 11

Between 200 and 270 tons per hour of #11 Waynesburg seam coal, $4\times 0$ grind, were treated in a hydrocyclone with a solution containing about 1% by weight ammonium nitrate. The coal was exposed to the reagent solution for a period of between 22 and 26 seconds. The processed coal was then dried and analyzed to determine the sulfur, ash and heat content.

| | raw, dry | processed, dry | % change |
|---|---|---|---|
| % ash, by weight | 27.71 | 14.88 | −46.3 |
| % sulfur, by weight | 4.62 | 3.77 | −18.4 |
| BTU/lb. | 10,057 | 11,317 | +21.0 |

EXAMPLE 12

Between 300 and 330 tons per hour of #8 Waynesburg seam coal, $4\times 0$ grind, were treated in a hydrocyclone with a solution containing between 2 and 3% by weight ammonium nitrate. The coal was exposed to the reagent solution for a period of between 22 and 26 seconds. The processed coal was then dried and analyzed to determine the sulfur, ash and heat content.

| | raw, dry | processed, dry | % change |
|---|---|---|---|
| % ash, by weight | 14.50 | 9.20 | −36.6 |
| % sulfur, by weight | 5.20 | 3.38 | −35.0 |
| BTU/lb. | 12,250 | 13,250 | +8.2 |

EXAMPLE 13

About 770 tons of Bakerstown/Freeport/Kittanning blend seam coals, $4\times\frac{3}{8}$ grind, were treated in a dense media classifier using the Tromp process with a reagent solution of between 0.8 and 1.2% by weight ammonium nitrate in a closed circulating reagent system of 1,800 gallons (15,000 lbs.) of water. The coal was exposed to the reagent solution for a period of about 30 seconds. The processed coal was then dried and analyzed to determine the sulfur, ash and heat content.

| | raw, dry | processed, dry | % change |
|---|---|---|---|
| % ash, by weight | 31.61 | 12.66 | −60.0 |
| % sulfur, by weight | 2.58 | 1.10 | −55.6 |
| BTU/lb. | 10,257 | 13,455 | +31.2 |

EXAMPLE 14

About 90 tons of Bakerstown coal, 2×0 grind, were treated in a dense media classifier using the Tromp process with various reagent solutions. The coal was exposed to the reagent solution for a period of about 30 seconds. The coal was then dried and analyzed to determine the sulfur and ash content.

| Reagent | % S by weight raw | % S by weight processed | % decrease in S content |
|---|---|---|---|
| 1.2% ammonium nitrate | 3.08 | 1.78 | −42.4 |
| 1.4% ammonium nitrate + 0.01% nonionic surfactant (Class I A2.2) | 3.98 | 2.00 | −49.7 |

EXAMPLE 15

Over 1,100 tons of Bakerstown/Kittanning/Freeport (1:1:1 blend) coal were treated in a dense media classifier using the Tromp process with a reagent solution of 5% by weight ammonium nitrate. The coal of 4×⅜ grind was exposed to the reagent solution for a period of 30 seconds. The coal finer than ⅜ grind was shunted around and blended back in with the processed coal. The coal was then dried and analyzed to determine the sulfur, ash and heat content. The tabulated results include the non-treated (⅜ minus) coal (blend).

| | raw, dry | processed, dry | % change |
|---|---|---|---|
| % ash, by weight | 17.30 | 14.25 | −17.6 |
| % S, by weight | 2.73 | 1.72 | −37.0 |
| BTU/lb. | 11,300 | 13,600 | +20.0 |

EXAMPLES 16–19

Ten tons of a Pennsylvania Bakerstown seam coal, 2×0 grind, were treated in a dense media classifier using the Tromp process without any reagent. The dry, processed coal had an ash content of 13.88%, a sulfur content of 3.52% and a heat content of 13,455 BTU/lb. Four additional ten ton portions of the same coal were processed using reagent solutions. The coal was exposed to the reagent for a period of about 30 seconds. The processed coal was then dried and analyzed to determine the sulfur, ash and heat content.

| Example | Reagent | % S, by wt. processed, dry | % ash, by wt. processed, dry | BTU/lb. |
|---|---|---|---|---|
| 16 | 1.2% ammonium nitrate | 1.98 | 13.11 | 13,513 |
| 17 | 1.0% ammonium nitrate | 1.88 | 13.55 | 13,465 |
| 18 | 1.0% ammonium nitrate +0.01% "W/S" nonionic/anionic surfactant | 1.98 | 12.37 | 13,609 |
| 19 | 1.0% ammonium nitrate +0.01% "W/S" nonionic/anionic surfactant | 1.81 | 13.01 | 13,560 |

Although the invention has been described with reference to specific processes and specific materials, the invention is only to be limited so far as is set forth in the accompanying claims.

I claim:

1. A process for reducing the sulfur and ash content of coal comprising the steps of:

(a) cleaning the coal to remove debris;

(b) pulverizing the coal;

(c) contacting the coal without external application of heat or pressure for on the order of 2 minutes or less with a reagent selected from the group consisting of aqueous solutions of active nitrogen containing compounds, aqueous solutions of organic compounds containing at least one hydroxyl group, surfactants containing active ammonium groups and combinations thereof;

(d) washing the coal with water; and (e) drying the coal.

2. A process as recited in claim 1 wherein said active nitrogen containing compound is selected from the group consisting of inorganic and organic ammonium salts, amides and amines.

3. A process as recited in claim 2 wherein said inorganic ammonium salts are selected from the group consisting of ammonium nitrate, ammonium bicarbonate, ammonium borate, ammonium tetraborate, ammonium carbonate, ammonium nitrate sulfate, ammonium nitrite, ammonium phosphate, monobasic ammonium phosphate, dibasic ammonium phosphate, ammonium sulfate and ammonium sulfite.

4. A process as recited in claim 2 wherein said organic ammonium salts are selected from the group consisting of ammonium acetate, ammonium binoxalate, dibasic ammonium citrate, ammonium oleate, ammonium oxalate and ammonium tartrate.

5. A process as recited in claim 2 wherein said amides are selected from the group consisting of formamide, acetamide, urea, urea peroxide, urea nitrate and phenylhydrazine.

6. A process as recited in claim 2 wherein said amines are selected from the group consisting of hydroxylamine, hydroxylamine sulfate and guanidine.

7. A process as recited in claim 1 wherein said surfactants containing active ammonium groups include quaternary ammonium cationic surfactants, such as Class IV A3 and ampholytes containing nitrogen and sullfur, but not phosphorus, in the surface-active ion; ammonium anionic surfactants, such as Class IV A1 containing sulfur, but not nitrogen or phosphorus in the anion, and containing nitrogen in the cation, Class IV A2 containing nitrogen and sulfur, but not phosphorus, in the anion and containing nitrogen in the cation and Class V C1 containing phosphorus, but not nitrogen or sulfur in the anion and nitrogen in the cation, and nonionic surfactants such as Class V A containing phosphorus.

8. A process as recited in claim 1 wherein the concentration of the reagent is between 0.001 and 20% by weight.

9. A process as recited in claim 1 wherein said coal is contacted by said reagent for a period of less than one minute.

10. A process as recited in claim 1 wherein said results in an agricultural by-product.

* * * * *